United States Patent [19]

Nottrott

[11] Patent Number: 5,073,132

[45] Date of Patent: Dec. 17, 1991

[54] FLAT CONTACT SPRING FOR PLUGS OF ELECTRICAL PLUG AND SOCKET CONNECTIONS

[75] Inventor: Rudolf Nottrott, Nuremberg, Fed. Rep. of Germany

[73] Assignee: TRW Daut & Rietz GmbH & Co. KG, Nuremberg, Fed. Rep. of Germany

[21] Appl. No.: 613,485

[22] PCT Filed: Feb. 16, 1990

[86] PCT No.: PCT/EP90/00256

§ 371 Date: Nov. 16, 1990

§ 102(e) Date: Nov. 16, 1990

[87] PCT Pub. No.: WO90/10322

PCT Pub. Date: Sep. 7, 1990

[30] Foreign Application Priority Data

Feb. 28, 1989 [DE] Fed. Rep. of Germany ..... 3906207

[51] Int. Cl.[5] ..... H01R 13/04; H01R 13/02

[52] U.S. Cl. ..... 439/884; 29/863; 29/874; 29/884; 439/885

[58] Field of Search ..... 439/882, 884–886, 439/888, 889, 891; 29/861, 863, 874, 882, 884

[56] References Cited

U.S. PATENT DOCUMENTS 4,030,804 6/1977 Enomoto ..... 439/884

4,979,915 12/1990 Pitts ..... 439/884

*Primary Examiner*—Paula A. Bradley

*Attorney, Agent, or Firm*—Collard, Roe & Galgano

[57] ABSTRACT

In order to improve the stability of a flat contact spring for plugs of electrical plug and socket connections which comprise connections for electrical conductors and a recess the marginal faces of which support a retaining tongue fastened to the spring housing, the contact spring is formed from a sheet metal cut-out with a first section composed of a central strip and longitudinal marginal strips which can be folded back onto the latter. The longitudinal marginal strips comprises cutouts which extend as far as their edges and which together form an undercut recess when the longitudinal marginal strips are folded back onto the central strip. A second section of the contact spring comprises a central strip and longitudinal marginal strips which can be folded back onto the latter and which have hooked notches which together interlock with the recess formed by the longitudinal marginal strips of the first section when the longitudinal marginal strips are folded back onto the central strip in order to attach the longitudinal marginal strips of the first and second sections.

7 Claims, 1 Drawing Sheet

FLAT CONTACT SPRING FOR PLUGS OF ELECTRICAL PLUG AND SOCKET CONNECTIONS

The invention relates to a flat contact spring for plugs of electrical plug and socket connections, which has crimped projections for connecting electrical wires as well as a recess which supports a holder tongue attached to the spring housing with its border surfaces.

It is known that flat contact springs for plugs of electrical plug and socket connections can be formed of a relatively thick sheet metal material. Adaptation of the thickness of the flat contact springs to the clear width of the socket contacts therefore requires the use of sheet metal materials with a greater or lesser thickness. Aside from the fact that the flat contact springs formed in this way demonstrate only a slight bending momentum lateral to the plug direction and are therefore easy to bend unintentionally, the plugging process is also made difficult. In addition, the cutting steps prove to be difficult, due to the increasing thickness of the sheet metal materials.

It is the task of the invention to facilitate the cutting processes for flat contact springs, as well as to create measures for increasing stability and adapting thickness to various opening widths of socket contacts.

According to the invention, this task is accomplished in that a sheet metal blank with a first segment having a center strip and longitudinal strips which can be folded up onto this center strip is provided, the longitudinal border strips of which have cut-outs which connect with the border edges, which together form a recess provided with undercuts when the longitudinal border strips are folded onto the center strip, and a second segment having a center strip and longitudinal border strips which can be folded up onto this center strip is provided, the longitudinal border strips having hook-shaped notches, which engage with the recess of the longitudinal border strips of the first segment when the longitudinal border strips are folded onto the center strip, jointly creating a positive lock for holding the longitudinal border strips of the first and second segment in place. The doubling of the flat contact spring achieved with the folding processes of the longitudinal border strips makes it possible to use a thin sheet metal material which is easily cut for the flat contact spring, and results in strengthening of the flat contact spring with the bending edges, especially lateral to the contact spring plane. In addition, since the undercuts engage with each other due to the hook-shaped notches, the parts of the two segments that lie on top of each other are held in place.

It is understood that the contact spring can be made with the same thickness over its entire length and width. In forming the flat contact spring, the first segment can have impressions in the center of the center strip and on the same side of the border edges of the longitudinal border strips of that segment, which form groove-shaped crimps in the center, on both sides of the flat contact spring, when the longitudinal border strips are folded onto the center strip. The crimps exercise a guidance function during the plugging process and also allow interaction of the flat contact spring with sockets of different widths and opening sizes, with the possibility that contact takes place only via the areas of the crimps, or via the flat contact spring areas which extend next to the crimps.

Furthermore, it is provided that the second segment has a recess in the center of the center strip and the longitudinal border strips of the second segment have recesses in the areas of the border edges, with half the width of the recess of the center strip, and that when the longitudinal border strips are folded onto the center strip, their recesses form a recess with the same axis, together with the recess of the center strip, the border edges of which can be brought into action with spring tongues attached to the spring housing.

Furthermore, it is provided that the center strip and the longitudinal border strips of the first segment be limited at their free ends, in the plane of the segment and at the border edges, by beveled surfaces. The beveled surfaces can be formed by grinding or pressing the free ends. It is also possible, however, to form the beveled surfaces of the border edges by cut-outs arranged in the areas of the bending lines for the longitudinal border edges.

Furthermore, it is also provided that the sheet metal blank be cut from a flat strip with a greater length, with the end facing towards the crimp projections attached to the strip, and that any desired number of additional sheet metal blanks be arranged on this strip. The flat strip facilitates handling of the sheet metal blanks, especially over the period of impressing and bending processes, or during additional processing, e.g. galvanic metal application. In addition, the flat contact springs can be stored and transported without requiring much space, by rolling up the flat strips, and are easily available by being removed from the flat strip.

For the production of flat contact springs, the process steps provided are that the two segments with center strips and longitudinal border strips as well as crimp projections are cut from a flat, thin sheet metal material, the center strip and the longitudinal border strips of the first segment are provided with impressions and the longitudinal border strips of both segments are folded onto the center strips of these segments, and the longitudinal border strips held in place relative to one another by engagement of the hook-shaped notches of the second segment with the cut-outs of the first segment.

The drawing illustrates an embodiment of the invention. Here:

Figure 1:
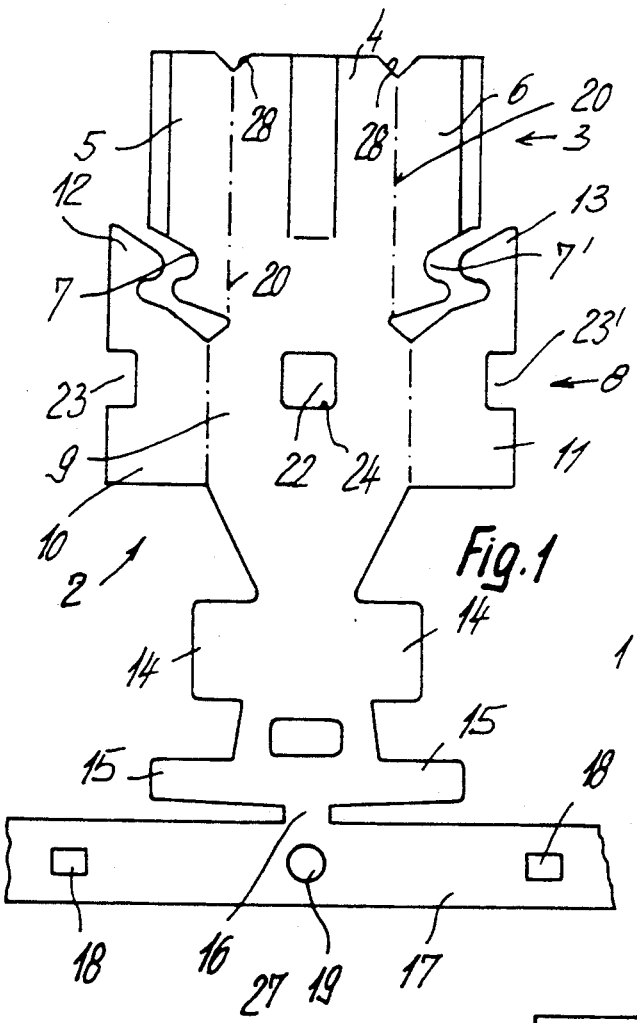
FIG. 1 shows a flat contact spring in a top view.
Figure 2:
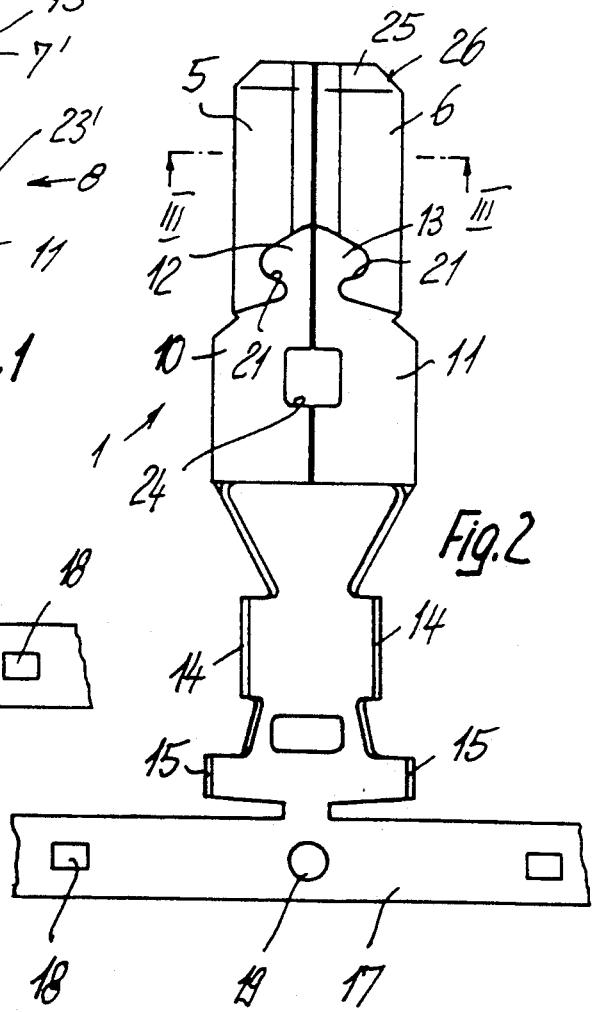
FIG. 2 shows a sheet metal blank for a flat contact spring according to FIG. 1.

The flat contact spring 1 of FIG. 1 can be produced from a sheet metal blank according to FIG. 2. The sheet metal blank 2 has a first segment 3 with a center strip 4 and longitudinal border strips 5 and 6 arranged on both sides of the center strip. The longitudinal border strips 5 and 6 are provided with cut-outs 7, 7' which connect with the border edges of the longitudinal border strips. Furthermore, the sheet metal blank has a second segment 8, which has a center strip 9 and longitudinal border strips 10 and 11 on both sides, with hook-shaped notches 12 and 13. Furthermore, the sheet metal blank is provided with projections 14, 15, which form crimp projections after bending. The sheet metal blank 2 is connected with and forms a piece of a flat strip 17, via a web 16; adjacent sheet metal blanks are formed in this strip, which also has transport openings 18 as well as coding openings 19 to determine the distance between sheet metal blanks.

To form the flat contact spring, the border strips 5 and 6 can be folded up onto the center strip 4 around bending lines 20, with the cut-outs 7, 7' together forming a recess with undercuts 21. When the border strips 10, 11 of the second segment 8 are folded onto the center strip 9, the hook-shaped notches 12, 13 together engage with these recesses and hold the longitudinal border strips 5, 6, 10, 11 of both segments 3, 8 in place on the center strips 4, 9. The hook-shaped notches 12, 13 support themselves against the undercuts 21 for this purpose. A recess 22 arranged in the center strip 9 of the second segment 8 and recesses 23, 23' provided in the longitudinal border strips 10, 11, with half the width, form a common recess when the longitudinal border strips 10, 11 are folded onto the center strip 9, the delimitation surfaces 24 of which can be brought into action as support surfaces for holder tongues (not shown) attached to the housing. The free ends of the center strip 4 and the longitudinal border strips 5, 6 of the first segment 3 are provided with beveled edges 25, 26, which allow easy insertion of the flat contact spring 1 into socket elements (not shown). The beveled surfaces 26 can be achieved by cut-outs 28 in the sheet metal blank.

Figure 3:
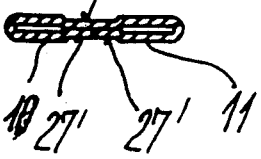
FIG. 3 shows a cross-section along Line III—III of FIG. 1.

FIG. 3 shows that the center strip 4 and the longitudinal border strips 5, 6 of the first segment 3 have impressions 27, 27', which are applied from one side before the folding process takes place. The impressions 27, 27' result in a groove-shaped thin spot and allow the interaction of the flat contact spring 1 with socket elements of different shapes and opening sizes. In addition, the impressions 27, 27' result in a guidance function over the period of the plugging processes.

I claim:

1. A flat contact spring for plugs of electrical plug and socket connections, which has crimped projections for connecting electrical wires as well as a recess which supports a holder tongue attached to the spring housing with its border surfaces, characterized by a sheet metal blank with a first segment (3) having a center strip (4) and a longitudinal strips (5, 6) which can be folded up onto this center strip is provided, the longitudinal border strips (5, 6) of which have cut-outs (7, 7') which connect with the border edges, which together form a recess provided with undercuts when the longitudinal border strips (5, 6) are folded onto the center strip (4), and a second segment (8) with a center strip (9) and longitudinal border strips (10, 11) which can be folded up onto this center strip is provided, the longitudinal border strips having hook-shaped notches (12, 13), which engage with the recess of the longitudinal border strips of the first segment (3) when the longitudinal border strips (5, 6) are folded onto the center strip (4), jointly creating a positive lock for holding the longitudinal border strips (5, 6, 10, 11) of the first and second segment in place.

2. A flat contact spring according to claim 1, characterized by the fact that the first segment (3) has impressions (27, 27') in the center of the center strip (4) and on the same side of the border edges of the longitudinal border strips (5, 6) of that segment, which form groove-shaped crimps in the center, on both sides of the flat contact spring, when the longitudinal border strips (5, 6) are folded onto the center strip (4).

3. A flat contact spring according to claim 1, characterized by the fact that the second segment (8) has a recess (22) in the center of the center strip (9) and the longitudinal border strips (10, 11) of the second segment have recesses (23, 23') in the areas of the border edges, with half the width of the recess (22), and that when the longitudinal border strips (10, 11) are folded onto the center strip (9), their recesses (23, 23') form a recess with the same axis, together with the recess (22) of the center strip.

4. A flat contact spring according to claim 1, characterized by the fact that the sheet metal blank (1) is cut from a flat strip (17), with the end close to the crimp projections (14, 15) attached to the strip, with additional, similar sheet metal blanks arranged on the strip.

5. A flat contact spring according to claim 1, characterized by the fact that the center strip (4) and the longitudinal border strips (5, 6) of the first segment (3) are limited at their free ends, in the plane of the segment and at the border edges, by beveled surfaces (25, 26).

6. A flat contact spring according to claim 5, characterized by the fact that the beveled surfaces (26) of the border edges can be formed by cut-outs (28) arranged in the areas of the bending lines for the longitudinal border edges.

7. A method for the production of contact springs for plugs according to claim 1, characterized by the fact that the two segments with center strips and longitudinal border strips as well as the crimp projections are cut from a flat piece of sheet metal, the center strip and the longitudinal border strips of the first segment are provided with impressions and the longitudinal border strips of both segments are folded onto the center strips and held in place against the center strip by engagement of the hook-shaped notches with the cut-outs of the longitudinal border strips.

* * * * *